United States Patent [19]

Lee

[11] Patent Number: 4,854,456

[45] Date of Patent: Aug. 8, 1989

[54] RACK STRUCTURE FOR BALLS AND RELATED EQUIPMENT

[76] Inventor: Juang J. Lee, 6F-1, 49, Sec. 2, Chang An E. Rd., Taipei, Taiwan

[21] Appl. No.: 230,755

[22] Filed: Aug. 10, 1988

[51] Int. Cl.[4] ..... A47F 7/00

[52] U.S. Cl. ..... 211/14; 211/70.5; 211/88; 211/175; 211/123; 211/206

[58] Field of Search ..... 211/14, 60.1, 70.5, 211/88, 90, 175, 13, 18, 123, 204, 206; 206/315.1, 315.9; D6/552

[56] References Cited

U.S. PATENT DOCUMENTS

| | | | |
|---|---|---|---|
| D. 198,349 | 6/1964 | Saunders | D6/552 |
| 797,614 | 8/1905 | Schipowsky | 211/90 X |
| 860,278 | 7/1907 | Botkin | 211/206 |
| 2,060,760 | 11/1936 | Keil | 211/90 X |
| 2,885,090 | 5/1959 | Forman et al. | 211/175 |
| 2,930,486 | 3/1960 | Hoover | 211/60.1 X |
| 2,950,003 | 8/1960 | Simmons et al. | 211/123 X |
| 2,972,417 | 2/1961 | Smith | 211/126 X |
| 3,650,407 | 3/1972 | Benham, Jr. | 211/14 |
| 3,669,395 | 6/1972 | Gehrke | 211/90 X |
| 3,869,137 | 3/1975 | Byrom | 211/14 X |
| 4,049,126 | 10/1988 | Inglis | 211/105.3 |
| 4,178,844 | 12/1979 | Ward et al. | 211/175 X |
| 4,188,890 | 2/1980 | de Villers | 211/123 X |
| 4,315,633 | 2/1982 | Boeddeker et al. | 211/60.1 X |
| 4,376,521 | 3/1983 | Walters | 211/90 X |
| 4,583,647 | 4/1986 | Schinzing | 211/87 X |
| 4,629,065 | 12/1986 | Braaten | 206/315.9 X |
| 4,678,087 | 7/1987 | York | 211/70.5 |
| 4,708,310 | 11/1987 | Smith | 248/220.1 |

FOREIGN PATENT DOCUMENTS

| | | | |
|---|---|---|---|
| 1272708 | 10/1960 | France | 211/123 |
| 1467884 | 12/1966 | France | 211/206 |

*Primary Examiner*—Ramon S. Britts
*Assistant Examiner*—David G. Kolman
*Attorney, Agent, or Firm*—Wenderoth, Lind & Ponack

[57] ABSTRACT

It is a rack structure for storing balls and related equipment thereof; the rack structure mainly comprises two frame plates, several horizontal rods, two side plates, and several hooks. The two frame plates are same in shape, and have several corresponding rod-inserting holes; each of the frame plates has at least a supporting arm. The rod-inserting holes can provide the horizontal rods with various assemblages. Every two horizontal rods is one set to be set up at a given angle against a wall so as to form a storage space. Each set of the horizontal rods is used for storing one size of balls. The fixed hooks on the frame plate may be used to hanging sports gloves. The two side plates are mounted on the outside of the tops of the frame plates respectively; each of the side plates has several slots with an open end for holding longer equipment each as rackets, baseball bats, and sleds, etc. The hooks having two symmetrical hooks are to be mounted on the horizontal rod with one end, while the other end is used to hang articles.

6 Claims, 4 Drawing Sheets

RACK STRUCTURE FOR BALLS AND RELATED EQUIPMENT

BACKGROUND OF THE INVENTION

1. Field of the Invention

This invention provides a rack structure for balls and related equipment. The rack structure mainly comprises two frame plates, of which each has several corresponding rod-inserting holes for mounting horizontal rods so as to form a storage space to store balls of different sizes. Each of the frame plates is mounted with a side plate having several slots for holding rackets, baseball bats or skis, etc. The frame plate is also furnished with several fixed hooks; further, there are several movable symmetrical hooks hung on the horizontal rod to hang articles.

2. Description of the Prior Art

In general, sports equipment is available for many kinds of sports, such as basketball, volleyball, football, rugby, baseball, and tennis, etc.; accordingly, there are many different sizes of rackets, bats, and gloves, etc. The equipment for skiing and boxing, especially, are of many different types and shapes. All the aforesaid sports equipment is difficult to store when not in use. The most common storage containers therefor are usually a pail, bucket, or box, etc. Given the prior art devices, balls and other sports equipment tended to be piled up somewhere and be difficult to locate when needed. Also, storage space was wasted and the appearance of piles of balls and sports equipment was unsightly.

SUMMARY OF THE INVENTION

The prime object of the present invention is to provide a rack structure for balls and related equipment that comprises several sets of horizontal rods, and each set consists of two horizontal rods being arranged at an angle and defining a space against the wall so as to store balls of different sizes. The rack structure also has two side plates with slots. Also, a plurality of fixed hooks and movable hooks are furnished for holding or hanging various kinds of sports equipment for the user's convenience.

Another object of the present invention is to provide a rack structure for balls and related equipment that is easy to assemble against a wall with a minimum space requirement to provide a maximum storage space without sacrificing the appearance of a room.

A further object of the present invention is to provide a rack structure for balls and related equipment that ensures the rod-inserting holes on the two frame plates are fully utilized for mounting the horizontal rods in that the rods can be assembled differently to meet different storage requirements of a user such as a family.

DETAILED DESCRIPTION

Figure 1:
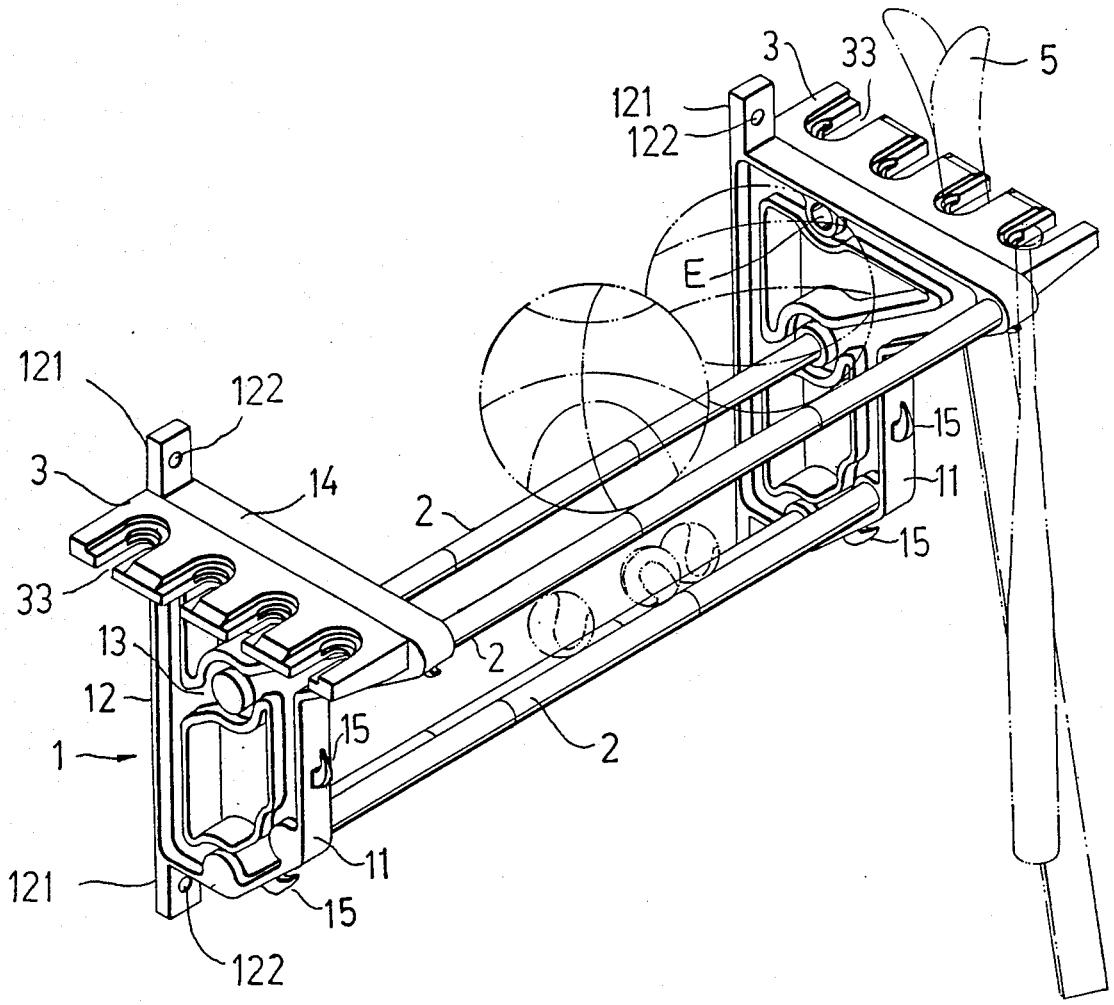
FIG. 1 is a perspective view of an embodiment of the present invention.
Figure 2:
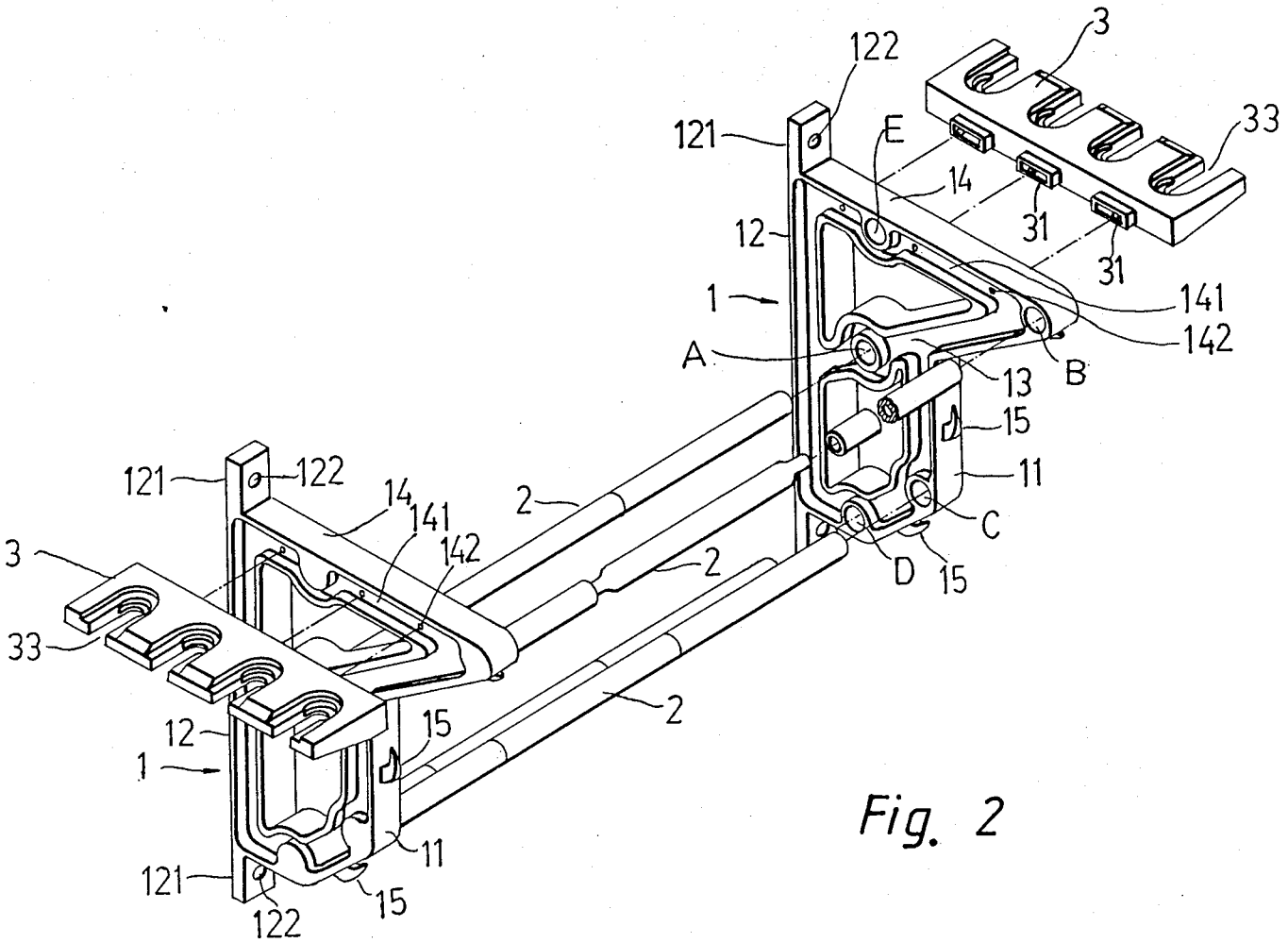
FIG. 2 is a disassembled view of the present invention.
Figure 3:
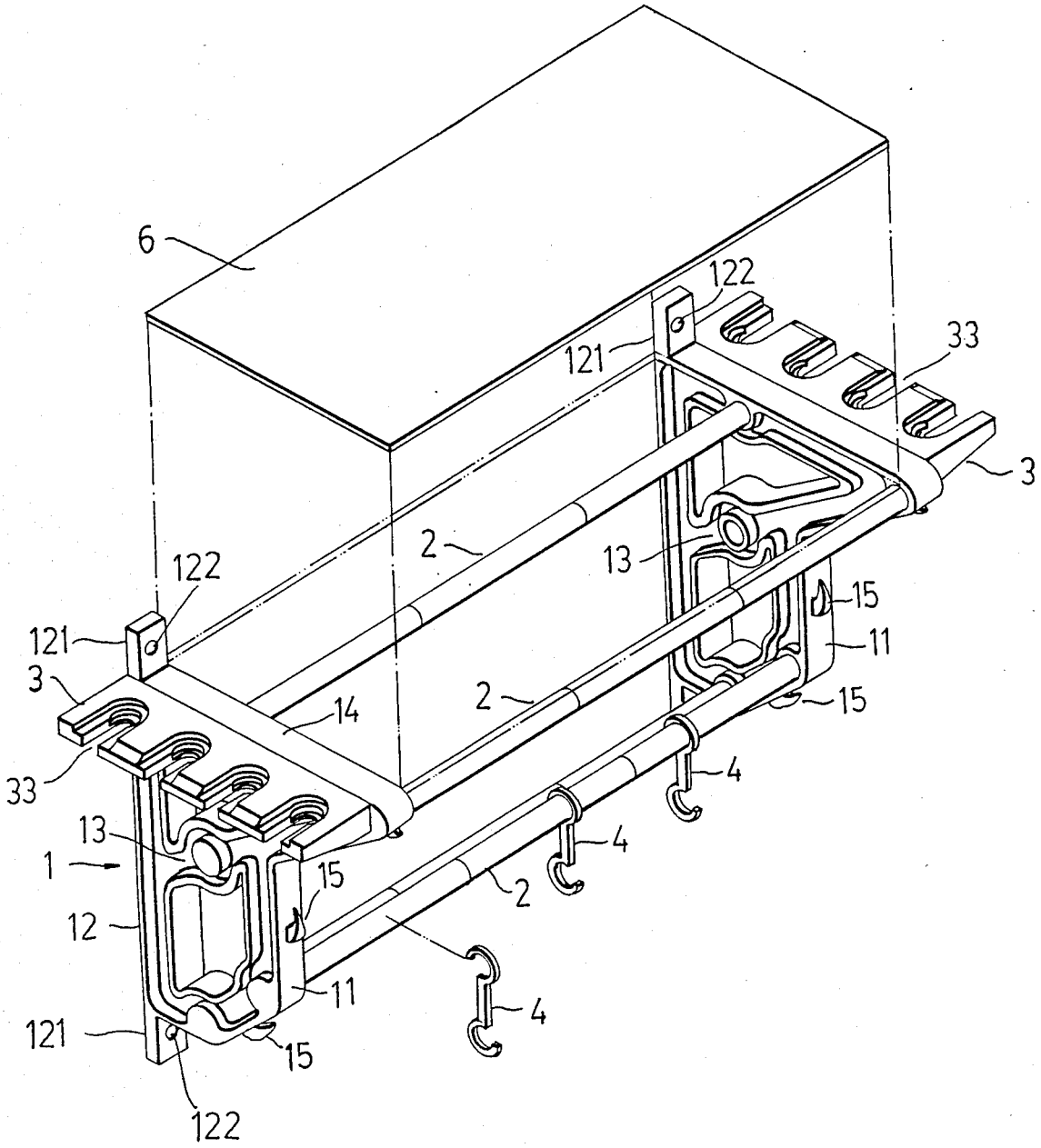
FIG. 3 is a perspective view of the present invention with minor modification on its assembled method.
Figure 4:
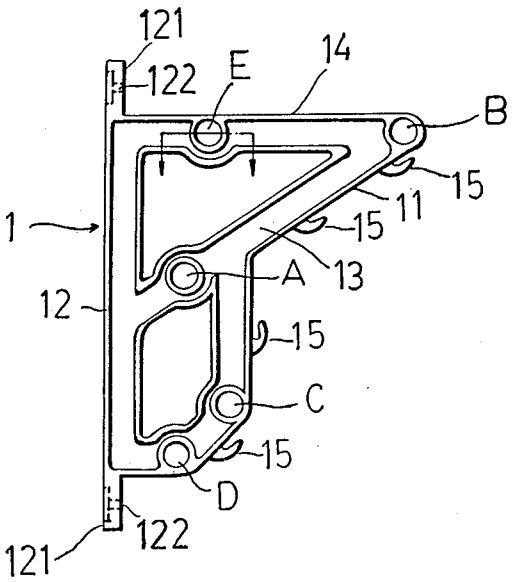
FIG. 4 illustrates a side view of the strip plate according to the present invention.

Referring to FIGS. 1 to 3, there is shown a rack structure for balls and related equipment that mainly comprises two frame plates 1, several horizontal rods 2, two side plates 3 and several hooks 4. The frame plate 1 is merely a frame with a side top portion and a narrow lower portion as shown in FIG. 4. The front side 11 of the frame plate 1 is formed into an indented shape gradually, and then is connected with the rear side 12 of the frame plate 1. Both ends of the rear side 12 are provided with lugs 121 and screw holes 122 respectively so as to attach the frame plate 1 on a wall. The central portion of the frame plate 1 has a support arm 13 being connected between the front side 11 and the rear side 12. The frame plate 1 is also furnished with rod-inserting holes A, B, C, D, and E, among which the hole E is a spare hole for mounting the horizontal rod 2 in different assembling position. The front side 11 of the frame plate 1 is provided with several fixed hooks 15 for hanging something. Moreover, both sides of the top portion of the frame plate 1 are provided with channels 141 of a suitable length and depth, and also furnished with two screw holes 142 at a suitable space so as to fixedly attach the two side plates 3 to the frame plates 1 respectively.

The diameter of the horizontal rods 2 is almost the same as that of the rod-inserting holes A, B, C, D and E so as to facilitate fitting the rod 2 therein. Every two horizontal rods 2 are to be mounted on the frame plate 1 as one set at a slanting angle against the wall. Each horizontal rod 2 includes three sections assembled together by inserting each rod 2 into the other as shown in FIG. 2 so as to reduce the length of the horizontal rods 2 for packing and shipping.

Figure 5:
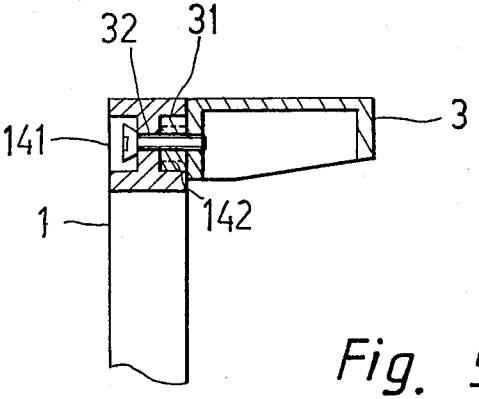
FIG. 5 is a sectional view showing how the side plate and the frame plate are assembled together.
Figure 6:
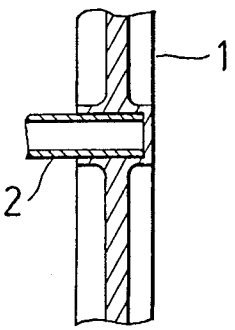
FIG. 6 is a sectional view showing how the horizontal rod and the frame plate are assembled together.

The side plate 3 is horizontally inserted into the channel 141 on the outer side of the top portion of the frame plate 1; the side plate 3 is provided with tenons 31 so as to have a better joint with the channel 141; the channel 141 is also furnished with several screw holes 142 corresponding with the tenons respectively so as to accommodate screws 32 to joining the frame plate 1 and the side plate 3 together as shown in FIG. 5. Furthermore, the outer edge of the side plate 3 is provided with several slots 33, of which each has an open end and a given length so as to hold long and flat equipment such as skis 5 or the like.

A detachable hook 4 includes two symmetrical hooks on both ends, of which one is hooked on the horizontal rod 2, while the other end is used for hanging something. The number of detachable hooks 4 is not limited.

As shown in FIG. 1, the four horizontal rods 2 are inserted into the rod-inserting holes A, B, C, and D respectively; the horizontal rods 2 inserted into the holes A and B form an upper layer shelf, while the horizontal rods 2 inserted into holes C and D form a lower layer shelf. However, the two shelves have different widths according to the structure of the frame plate 1 so as to store balls of different sizes. The slots 33 on the side plates 3 are used for holding rackets, bats, baseball bats, skis 5 (as shown in phantom lines in FIG. 1) or other related equipment. The hooks 4 may be hung at any position on the horizontal rod 2 for hanging sports equipment.

FIG. 3 illustrates a horizontal rod 2 being fitted in rod-inserting hole E instead of in hole A so as to meet a different storage requirement; in that case, a board 6 can be placed on the top of the frame plate 1 for storing other items, and the space under the board 6 has more room for storage. In other words, the present invention may be varied by a different assembling method to meet a given requirement.

Briefly, the structure and features of the present invention may be changed or modified slightly by a person skilled in the art, such as by increasing the length of the frame plate for mounting more layers of horizontal rods, or such as by the frame plate and the side plate being modified into other forms; in that case, such minor changes to the present invention would be deemed still within the scope of claims of the present invention.

The invention claimed is:

1. A rack structure for balls and related equipment comprising:

two frame plates having a wide upper portion and a narrow lower portion, a front side of each said frame plate having an indented edge with a plurality of stepped indentations, and being connected together with a rear side of each said frame plate, and a supporting arm attached to and extending between said front side and said rear side;

means for forming a variety of different storage spaces including a plurality of rod-inserting holes of the same diameter defined in said lower portion, in said supporting arm, and in said upper portion, collectively, of each said frame plate, and a plurality of horizontal rods, each one of said plurality of horizontal rods including a plurality of sections detachably assembled together, and the diameter of each one of said plurality of horizontal rods being substantially the same as the diameter of said plurality of rod-inserting holes in said two frame plates for mating therewith, one of the variety of different storage spaces being bounded by a wall, a first horizontal rod, and a second horizontal rod which is spaced horizontally and vertically away from said first horizontal rod;

two side plates being fixedly inserted into the outside of said upper portions of said two frame plates respectively, and a plurality of rigid slots defined in each one of said two side plates;

a plurality of detachable hooks, each one of said plurality of detachable hooks having two spaced opposed ends, a hook portion at each one of said spaced opposed ends of each one of said plurality of detachable hooks, each said hook portion being symmetrical to the other one of said hook portions, and each one of said plurality of detachable hooks being detachably attached to one of said plurality of horizontal rods by one of said hook portions of said plurality of detachable hooks and the other one of said hook portions being free for hanging something thereon; and wherein, each one of said plurality of horizontal rods after being assembled from said plurality of sections is inserted into respective ones of said plurality of rod-inserting holes to form said rack structure with a required space, said rack structure then being fixedly attachable to the wall at a suitable height, and then said rack structure being complete for use.

2. A rack structure as in claim 1, wherein at least two lugs are attached to said upper and lower portions of said two frame plates at each rear side thereof, and at least one screw hole is defined in each one of said at least two lugs.

3. A rack structure as in claim 1, wherein a plurality of fixed hooks is fixedly attached to said front side of each one of said two frame plates.

4. A rack structure as in claim 1, wherein a channel is defined in the outside of each one of said upper portions of said two frame plates, and a plurality of screw holes is defined in each one of said channels.

5. A rack structure as in claim 1, wherein each one of said plurality of rod-inserting holes is spaced apart from each of the other ones of said plurality of rod-inserting holes at a variety of distances, whereby when said plurality of horizontal rods are inserted into said plurality of rod-inserting holes the variety of storage spaces is defined thereby for storing a plurality of different balls.

6. A rack structure as in claim 1, wherein a plurality of tenons is defined on one side of each one of said two side plates that is to be fixedly inserted in the outside of said upper portions of said two frame plates, a like plurality of mating mortises corresponding to said plurality of tenons is defined in said upper portions of each one of said two frame plates, and a plurality of screw holes is defined in each one of said plurality of mortises for joining said two side plates and said two frames plates together.

* * * * *